US007764016B2

(12) United States Patent
Park et al.

(10) Patent No.: US 7,764,016 B2
(45) Date of Patent: Jul. 27, 2010

(54) PLASMA DISPLAY DEVICE

(75) Inventors: Yu Park, Seoul (KR); Tae Deok Seo, Kimchun-si (KR); Jun Hwan Ju, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 501 days.

(21) Appl. No.: 11/729,884

(22) Filed: Mar. 30, 2007

(65) Prior Publication Data

US 2008/0012491 A1 Jan. 17, 2008

(30) Foreign Application Priority Data

Jul. 12, 2006 (KR) ..... 10-2006-0065508
Sep. 28, 2006 (KR) ..... 10-2006-0094688

(51) Int. Cl.
*H01J 17/04* (2006.01)
*H01J 9/20* (2006.01)

(52) U.S. Cl. ..... 313/582; 313/581; 313/583; 445/23

(58) Field of Classification Search ..... 313/495, 313/582–561; 445/23
See application file for complete search history.

(56) References Cited

U.S. PATENT DOCUMENTS 6,657,387 B1 * 12/2003 Yoo ..... 313/587
2006/0145578 A1 * 7/2006 Park et al. ..... 313/112
2006/0250064 A1 11/2006 Park et al.
2007/0120485 A1 * 5/2007 Kim ..... 313/582

FOREIGN PATENT DOCUMENTS

| | | |
|---|---|---|
| EP | 1 677 336 | 7/2006 |
| EP | 1 770 750 | 4/2007 |
| EP | 1 798 749 | 6/2007 |
| JP | 2001-034183 | 2/2001 |
| JP | 2004-286996 | 10/2004 |

OTHER PUBLICATIONS

European Search Report dated Nov. 22, 2007.

* cited by examiner

*Primary Examiner*—Bumsuk Won
*Assistant Examiner*—Nathaniel J Lee
(74) *Attorney, Agent, or Firm*—KED & Associates, LLP

(57) ABSTRACT

A plasma display apparatus may include a plasma display panel (PDP), and a filter disposed at a front of the PDP. The filter may include an external light shielding sheet having a base unit and a plurality of pattern units formed on the base unit. Each of the pattern units may include a bottom and first and second slanted surfaces which are connected to the bottom. A thickness of the external light shielding sheet may be in a range of 1.01 to 1.5 times greater than a height of each of the pattern units and a first interior angle between the first slanted surface and the bottom of each of the pattern units may differ from a second interior angle between the second slanted surface and the bottom of each of the pattern units.

28 Claims, 13 Drawing Sheets

PLASMA DISPLAY DEVICE

The present application claims priority from Korean Patent Application No. 10-2006-0065508, filed Jul. 12, 2006 and Korean Patent Application No. 10-2006-0094688, filed Sep. 28, 2006, the subject matters of which are incorporated herein by reference.

BACKGROUND

1. Field

Embodiments of the present invention may relate to a plasma display apparatus. More particularly, embodiments of the present invention may relate to a plasma display apparatus in which an external light shielding sheet is provided that is made of two materials having different refractive indexes in order to shield external light incident from outside of a panel. The external light shielding sheet may be disposed at a front of the panel to thereby improve bright and dark room contrast of the panel and luminance.

2. Background

A plasma display panel (hereinafter a "PDP") is an apparatus configured to generate discharge by applying voltage to electrodes disposed in discharge spaces and to display an image including characters and/or graphics by exciting phosphors with plasma generated during the discharge of gas. The PDP may be advantageous in that it can be made large, light and thin, may provide a wide viewing angle, and may implement full colors and high luminance.

In the PDP, when a black image is implemented, external light may be reflected on a front of the panel due to white-based phosphor exposed on a lower plate of the panel. Therefore, a problem may arise because a black image is recognized as a bright-based dark color, which may result in a lower contrast.

SUMMARY OF THE INVENTION

The present invention provides a plasma display apparatus.

According to an aspect of the present invention, there is provided a plasma display apparatus, including a plasma display panel (PDP) and a filter disposed at a front of the PDP, the filter including an external light shielding sheet having a base unit and a plurality of pattern units formed on the base unit, wherein each of the pattern units includes a bottom and first and second slanted surfaces which are connected to the bottom, a thickness of the external light shielding sheet is in a range of 1.01 to 1.5 times greater than a height of each of the pattern units and a first interior angle between the first slanted surface and the bottom of each of the pattern units differs from a second interior angle between the second slanted surface and the bottom of each of the pattern units.

According to another aspect of the present invention, there is provided a filter, including an external light shielding sheet which includes a base unit and a plurality of pattern units formed on the base unit, wherein each of the pattern units includes a bottom and first and second slanted surfaces which are connected to the bottom, a thickness of the external light shielding sheet is in a range of 1.01 to 1.5 times greater than a height of each of the pattern units and a first interior angle between the first slanted surface and the bottom of each of the pattern units differs from a second interior angle between the second slanted surface and the bottom of each of the pattern units.

BRIEF DESCRIPTION OF THE DRAWINGS

Embodiments may be described in detail with reference to the following drawings in which like reference numerals refer to like elements and wherein.

DETAILED DESCRIPTION

A plasma display apparatus according to example embodiments of the present invention will now be described with reference to the accompanying drawings. Embodiments of the present invention are not limited to the embodiments described in this specification.

Figure 1:
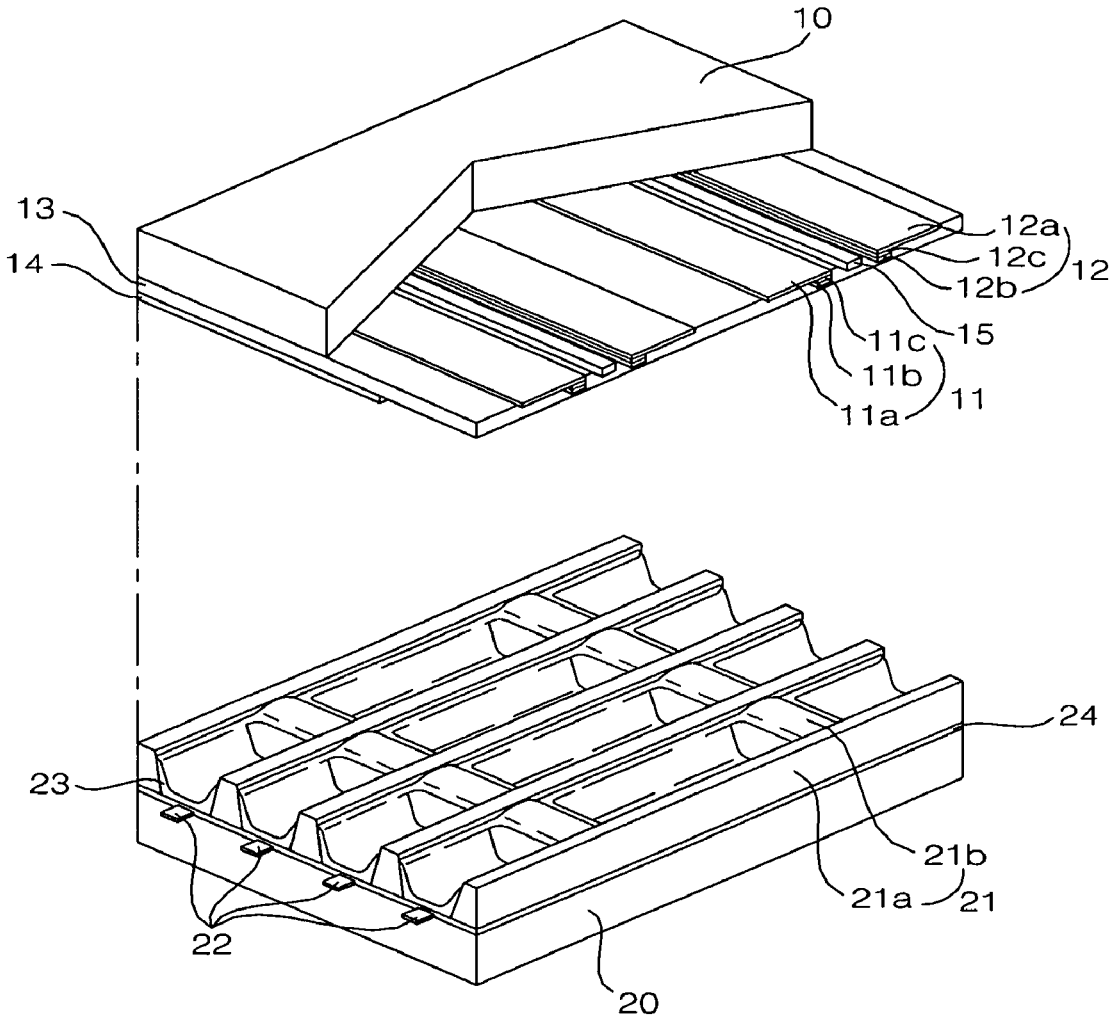
FIG. 1 is a perspective view illustrating a PDP according to an example embodiment of the present invention.

FIG. 1 is a perspective view illustrating a PDP according to an example embodiment of the present invention. Other embodiments and configurations are also within the scope of the present invention.

As shown in FIG. 1, the PDP may include a scan electrode 11 and a sustain electrode 12 (i.e., a sustain electrode pair) both of which are formed on a front substrate 10, and address electrodes 22 formed on a rear substrate 20.

The sustain electrode pair 11 and 12 includes transparent electrodes 11*a* and 12*a* and bus electrodes 11*b* and 12*b*. The transparent electrodes 11*a* and 12*a* may be formed of Indium-Tin-Oxide (ITO). The bus electrodes 11*b* and 12*b* may be formed using metal such as silver (Ag) or chrome (Cr), a stack of Cr/copper (Cu)/Cr, and/or a stack of Cr/aluminum (Al)/Cr. The bus electrodes 11*b* and 12*b* may be formed on the transparent electrodes 11*a* and 12*a* and serve to reduce a voltage drop caused by the transparent electrodes 11*a* and 12*a* having a high resistance.

The PDP may further include a black matrix (BM) having a light-shielding function of reducing reflection of external light generated from outside of the front substrate 10 by absorbing the external light. The black matrix may improve purity of the front substrate 10 and contrast of the PDP.

The black matrix may include a first black matrix 15 formed at a location to overlap with a barrier rib 21 formed on the rear substrate 20 and second black matrices 11*c* and 12*c* formed between the transparent electrodes 11*a* and 12*a* and the bus electrodes 11*b* and 12*b*.

The black matrix that is separated into the first black matrix 15 and the second black matrices 11*c* and 12*c* may be called a "separation type BM". The second black matrices 11*c* and 12*c* may be called a "black layer" or a "black electrode layer" since they form a layer between the electrodes.

An upper dielectric layer 13 and a protection layer 14 are laminated on the front substrate 10 in which the scan electrodes 11 and the sustain electrodes 12 are formed in parallel. Charged particles from which plasma is generated are accumulated on the upper dielectric layer 13. The protection layer 14 functions to protect the upper dielectric layer 13 from sputtering of charged particles generated during discharge of a gas and also to increase emission efficiency of secondary electrons.

The address electrodes 22 are formed on the rear substrate 20 in such a way to cross the scan electrodes 11 and the sustain electrodes 12. A lower dielectric layer 24 and barrier ribs 21 are also formed on the rear substrate 20 on which the address electrodes 22 are formed.

Phosphors 23, which are emitted by ultraviolet (UV) generated during the discharge of gas to generate a visible ray, may be coated on surfaces of the lower dielectric layer 24 and the barrier ribs 21.

Each of the barrier ribs 21 may include a longitudinal barrier rib 21*a* parallel to the address electrodes 22 and a traverse barrier rib 21*b* traversing the address electrodes 22. The barrier ribs 21 function to physically separate discharge cells and also prevent ultraviolet rays generated by a discharge and a visible ray from leaking to neighboring discharge cells.

The structure of the panel illustrated in FIG. 1 is one example embodiment of the PDP. Embodiments of the present invention are not limited to the structure of the panel shown in FIG. 1. For example, the PDP may have a structure in which the sustain electrode pair 11 and 12 includes only the bus electrodes 11*b* and 12*b*, respectively, without including the transparent electrodes 11*a* and 12*a* (and/or the transparent electrodes 11*a* and 12*a* made of ITO). Such a structure that does not use the transparent electrodes 11*a* and 12*a* may be advantageous in that the structure may save manufacturing cost of a panel. Furthermore, the bus electrodes 11*b* and 12*b* may be formed using a variety of materials such as a photoresist material in addition to the materials described above.

The barrier rib structure of the PDP shown in FIG. 1 is a close type barrier rib structure in which the discharge cells are closed by the longitudinal barrier ribs 21*a* and the traverse barrier ribs 21*b*. However, embodiments of the present invention are not limited to a barrier rib structure as the barrier ribs may include a stripe type (not including the traverse barrier ribs 21*b*), a differential type barrier rib structure (in which the longitudinal barrier rib 21*a* and the traverse barrier rib 21*b* have different heights), a channel type barrier rib structure (in which a channel that can be used as an exhaust passage is formed in at least one of the longitudinal barrier rib 21*a* or the traverse barrier rib 21*b*), a hollow type barrier rib structure (in which a hollow is formed in at least one of the longitudinal barrier rib 21*a* and the traverse barrier rib 21*b*), and/or etc.

In the differential type barrier rib structure, the traverse barrier rib 21*b* may have a higher height than the longitudinal barrier rib 21*a*. In the channel type barrier rib structure or the hollow type barrier rib structure, a channel or a hollow may be formed in the traverse barrier rib 21*b*.

Meanwhile, in an example embodiment of the present invention, R, G, and B discharge cells may be arranged on a same line. The R, G, and B discharge cells may also be arranged in different fashions. For example, the R, G, and B discharge cells may also have a delta type arrangement in which the R, G and B discharge cells are arranged in a triangular form (or shape). Furthermore, the discharge cells may be arranged in a variety of forms or shapes such as a square, a pentagon and/or a hexagon.

Figure 2:
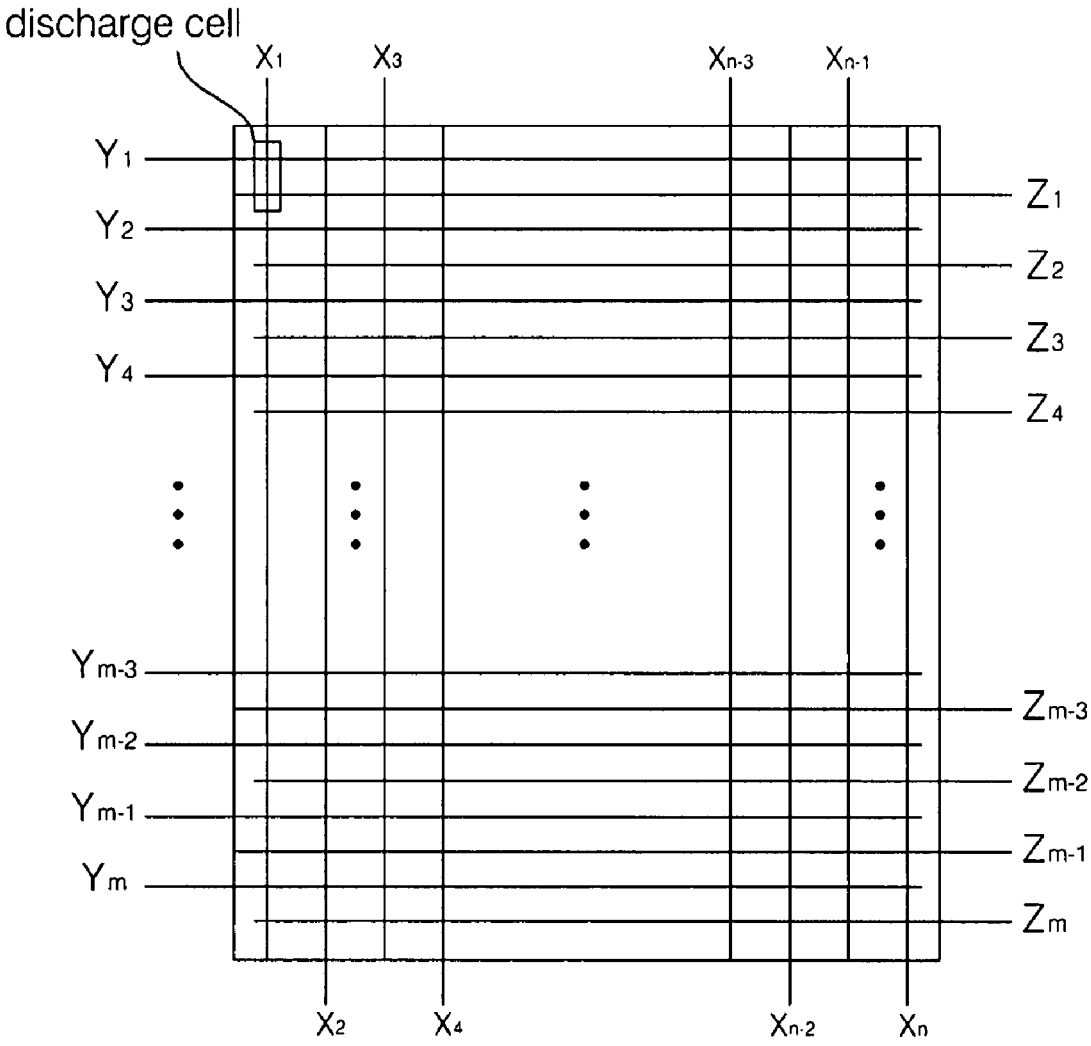
FIG. 2 is a view illustrating an electrode arrangement of a PDP according to an example embodiment of the present invention.

FIG. 2 is a view illustrating an electrode arrangement of a PDP according to an example embodiment of the present invention. Other embodiments and configurations are also within the scope of the present invention. As shown in FIG. 2, a plurality of discharge cells constituting the PDP may be arranged in a matrix form. The plurality of discharge cells may be respectively disposed at intersections of scan electrode lines Y1 to Ym, sustain electrodes lines Z1 to Zm, and address electrodes lines X1 to Xn. The scan electrode lines Y1 to Ym may be driven sequentially or simultaneously. The sustain electrode lines Z1 to Zm may be driven at a same time. The address electrode lines X1 to Xn may be divided into even-numbered lines and odd-numbered lines and driven separately, or the electrode lines may be driven sequentially.

The electrode arrangement shown in FIG. 2 is only an example embodiment. Embodiments of the present invention are not limited to the FIG. 2 electrode arrangement and driving method. For example, embodiments of the present invention may include a dual scan method in which two of the scan electrode lines Y1 to Ym are scanned at a same time. The address electrode lines X1 to Xn may be driven by being divided into upper and lower parts about a center of the panel.

Figure 3:
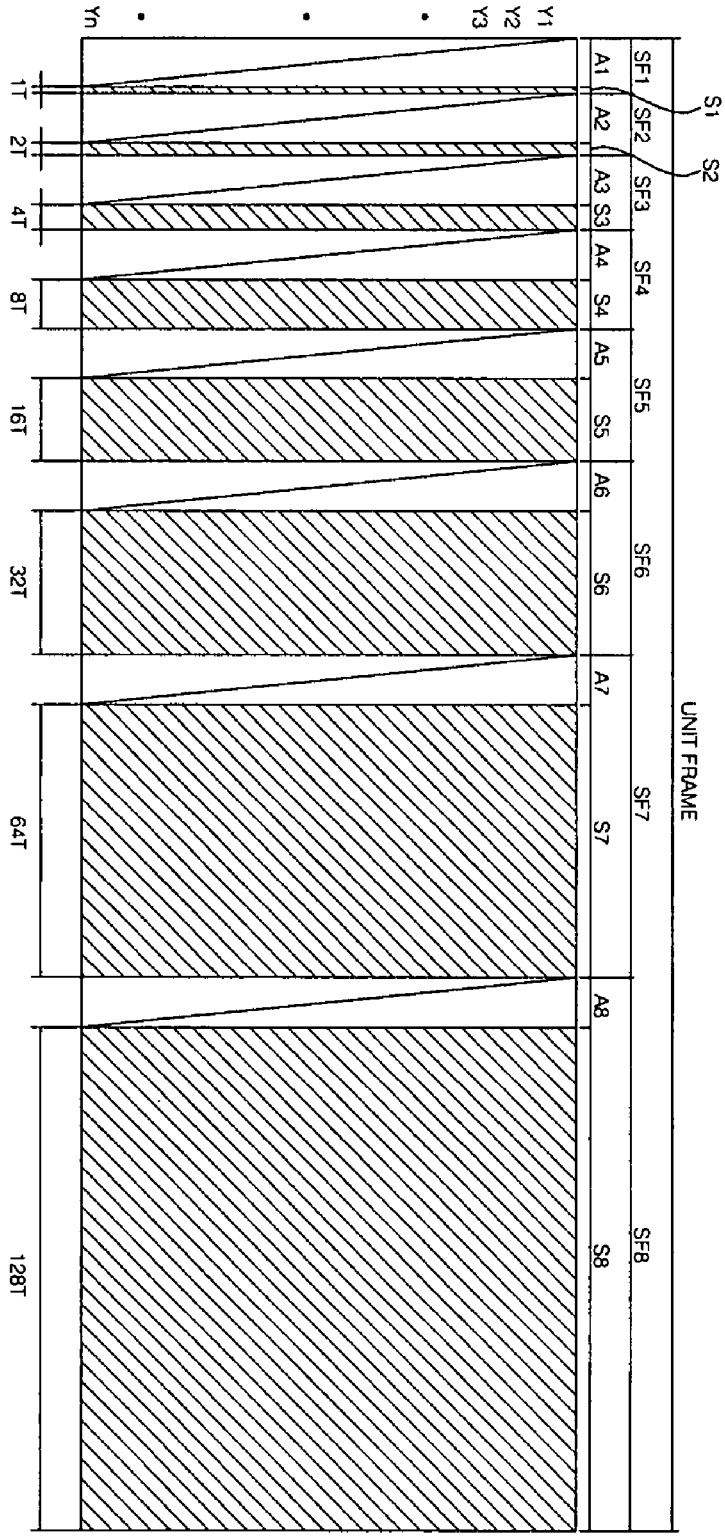
FIG. 3 is a timing diagram showing a method of driving a plasma display apparatus with one frame of an image time-divided into a plurality of subfields according to an example embodiment of the present invention.

FIG. 3 is a timing diagram showing a method of driving a PDP with one frame of an image time-divided into a plurality of subfields according to an example embodiment of the present invention. Other embodiments and configurations are also within the scope of the present invention.

As shown in FIG. 3, a unit frame may be divided into a predetermined number of subfields (e.g., eight subfields SF1, . . . , SF8) in order to represent gray levels of an image. Each of the subfields SF1, . . . , SF8 may be divided into a reset period (not shown), an address period (A1, . . . , A8), and a sustain period (S1, . . . , S8).

In each of the address periods A1, . . . , A8, data signals may be applied to the address electrodes X and scan pulses corresponding to the data signals may be sequentially applied to the scan electrodes Y. In each of the sustain periods S1, . . . , S8, a sustain pulse may be alternately applied to the scan electrodes Y and the sustain electrodes Z. Accordingly, a sustain discharge may be generated in discharge cells selected in the address periods A1, . . . , A8.

Luminance of the PDP may be proportional to a number of sustain discharges within the sustain periods S1, . . . , S8 in the unit frame. In the case where one frame constituting 1 image is represented by eight subfields and 256 gray levels, a different number of sustain pulses may be sequentially allocated to each subfield in a ratio of 1, 2, 4, 8, 16, 32, 64 and 128. Furthermore, in order to obtain a luminance of 133 gray levels, cells can be addressed during the subfield1 period (SF1), the subfield3 period (SF3), and the subfield8 period (SF8), thus generating a sustain discharge.

Meanwhile, a number of sustain discharges allocated to each subfield may be variably decided depending on weights of the subfields. For example, FIG. 3 shows an example in which one frame is divided into eight subfields. However, embodiments of the present invention are not limited to this example, but rather a number of subfields constituting one frame may be changed depending on design specifications. For example, the PDP may be driven by dividing one frame into eight or more subfields, such as 12 or 16 subfields.

FIGS. 4 to 9 are cross-sectional views illustrating an external light shielding sheet according to example embodiments of the present invention. Other embodiments and configurations are also within the scope of the present invention. As shown in FIGS. 4 to 9, an external light shielding sheet 100 may include a base unit 110 and pattern units 120.

External light affecting lowering in bright and dark room contrast of the PDP may exist over a head of a user. Such external light may be refracted into the pattern units 120 and may be absorbed and shielded. In order for light emitted from the panel (so as to display an image) to be totally reflected from inclined surfaces c and d of the pattern unit 120, a refractive index of each of the pattern units 120 may be lower than a refractive index of the base unit 110. By absorbing the external light so that it is not reflected toward a viewer side and increasing an amount of reflection of light emitted from the panel, bright and dark room contrast of a display image can be improved.

In order to maximize (or increase) absorption of external light and total reflection of panel light considering an angle of the external light incident on the panel, a refractive index of the pattern unit 120 may be 0.3 to 0.999 times greater than the refractive index of the base unit 110. In order to maximize (or increase) the total reflection of light emitted from the panel from the inclined surfaces of the pattern unit 120, the refractive index of the pattern unit 120 may be 0.3 to 0.8 times greater than the refractive index of the base unit 110 considering upper and lower viewing angles of the PDP.

The base unit 110 may be formed of a transparent plastic material having a given refractive index that enables light to be transmitted smoothly and also enable light to be refracted at a given angle. For example, the base unit 110 may be formed using a resin-based material formed by an ultraviolet (UV) hardening method. The base unit 110 may also be formed using a firm glass material in order to increase an effect of protecting the front of the panel.

The pattern units 120 configured to shield external light to a greatest extent possible and formed on the base unit 110 may have a sectional shape in which width of a bottom "b" is greater than a width of a top "a". For example, the sectional shape of the pattern unit 120 may be a triangle in which the width of the top "a" is close to 0. The sectional shape of the pattern unit 120 may also be a trapezoid having a given width, a curved shape or the like.

In order to maximize the external light shielding effect of the external light shielding sheet 100, the top "a" of the pattern unit 120 may be disposed on a user side A on which light is incident from the outside, and the bottom "b" of the pattern unit 120 may be disposed on the panel side B.

The pattern units 120 may show a color darker than a color of the base unit 110 made of a transparent plastic material. The pattern unit 120 may include a material having an optical absorption characteristic in order to further effectively shield and absorb externally incident light. Alternatively, the pattern unit 120 may include a black-based material, or the pattern unit 120 may have surfaces coated with a black-based material.

In order to shield external light existing over a head of a user and to secure a further widened aperture ratio of the panel, angles formed by the bottom "b" of the pattern unit 120 and each of the two inclined surfaces c and d (divided into upper and lower sides based on a location in which an external light source exists) may differ from one another.

In other words, a first interior angle θ1 formed by an upper-side inclined surface c and the bottom b may be smaller than a second interior angle θ2 formed by a lower-side inclined surface d and the bottom b. The second interior angle θ2 of the pattern unit 120 may be 1.01 to 1.45 times greater than the first interior angle θ1.

When the second interior angle θ2 of the pattern unit 120 is 1.02 to 1.32 times greater than the first interior angle θ1, the aperture ratio of the external light shielding sheet 100 can be secured by maximizing (or increasing) a range allowable in fabrication of the pattern units, and the external light shielding effect and reflection of interior light of the panel can be maximized.

The following Table 1 shows experimental results based on an aperture ratio of the external light shielding sheet 100 and an interior light of the panel that has been passed depending on the first interior angle θ1 and the second interior angle θ2 of the pattern units 120.

TABLE 1

| θ1 (degrees) | θ2 (degrees) | Aperture Ratio (%) | Internal Light Passed |
|---|---|---|---|
| 80 | 80 | 50 | ○ |
| 80 | 82 | 60 | ○ |
| 80 | 85 | 63 | ○ |
| 80 | 87 | 65 | ○ |
| 80 | 90 | 68 | ○ |
| 80 | 92 | 70 | ○ |
| 80 | 95 | 73 | ○ |
| 80 | 98 | 75 | ○ |
| 80 | 100 | 78 | ○ |
| 80 | 105 | 80 | ○ |
| 80 | 110 | 83 | Δ |
| 80 | 115 | 85 | Δ |
| 80 | 120 | 88 | X |
| 80 | 125 | 90 | X |

As shown in Table 1, in the case where the first interior angle θ1 of the pattern unit 120 is 80 degrees, only when the second interior angle θ2 of the pattern unit 120 is higher than 80 degrees, an aperture ratio in which a loss of transmittance of the interior light can be minimized compared with a contrast ratio of the panel exceeds 50%, and at a same time, the aperture ratio gradually increases. If the second interior angle θ2 becomes 120 degrees, however, the aperture ratio increases to 88%, but light emitted from the interior of the panel can not pass.

In other words, when the second interior angle θ2 of the pattern unit 120 is 1.01 to 1.45 times greater than the first interior angle θ1, the aperture ratio of the external light shielding sheet 100 can be secured sufficiently, and light emitted from the interior of the panel can sufficiently pass externally.

Furthermore, in order to maximize the aperture ratio and the transmission of the panel interior light considering the convenience of a manufacturing process, the second interior angle θ2 of the pattern unit 120 may be 1.02 to 1.32 times greater than the first interior angle θ1. However, the second interior angle θ2 may be in a range of 81 degrees to 115 degrees.

Figure 4:
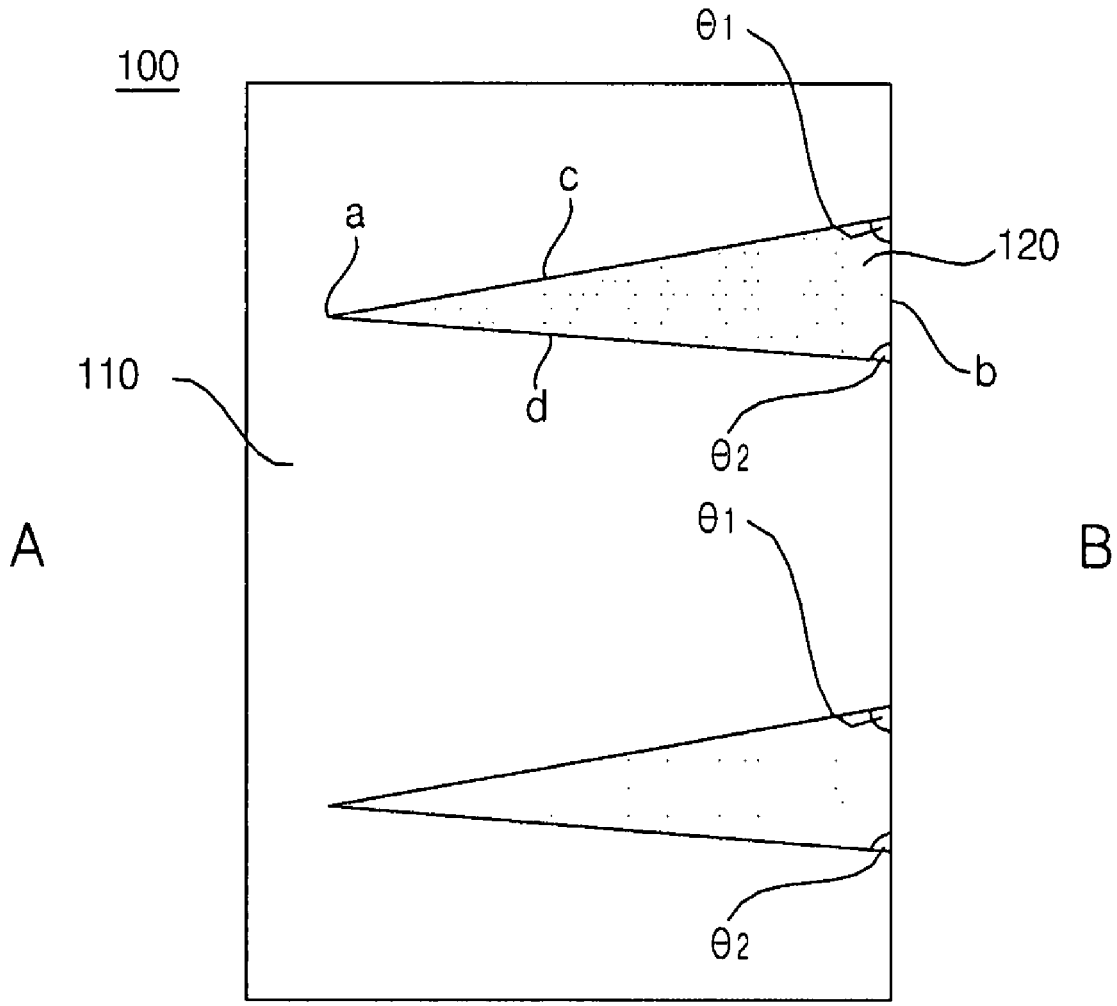
FIGS. 4 to 9 are cross-sectional views illustrating an external light shielding sheet according to example embodiments of the present invention.
Figure 5:
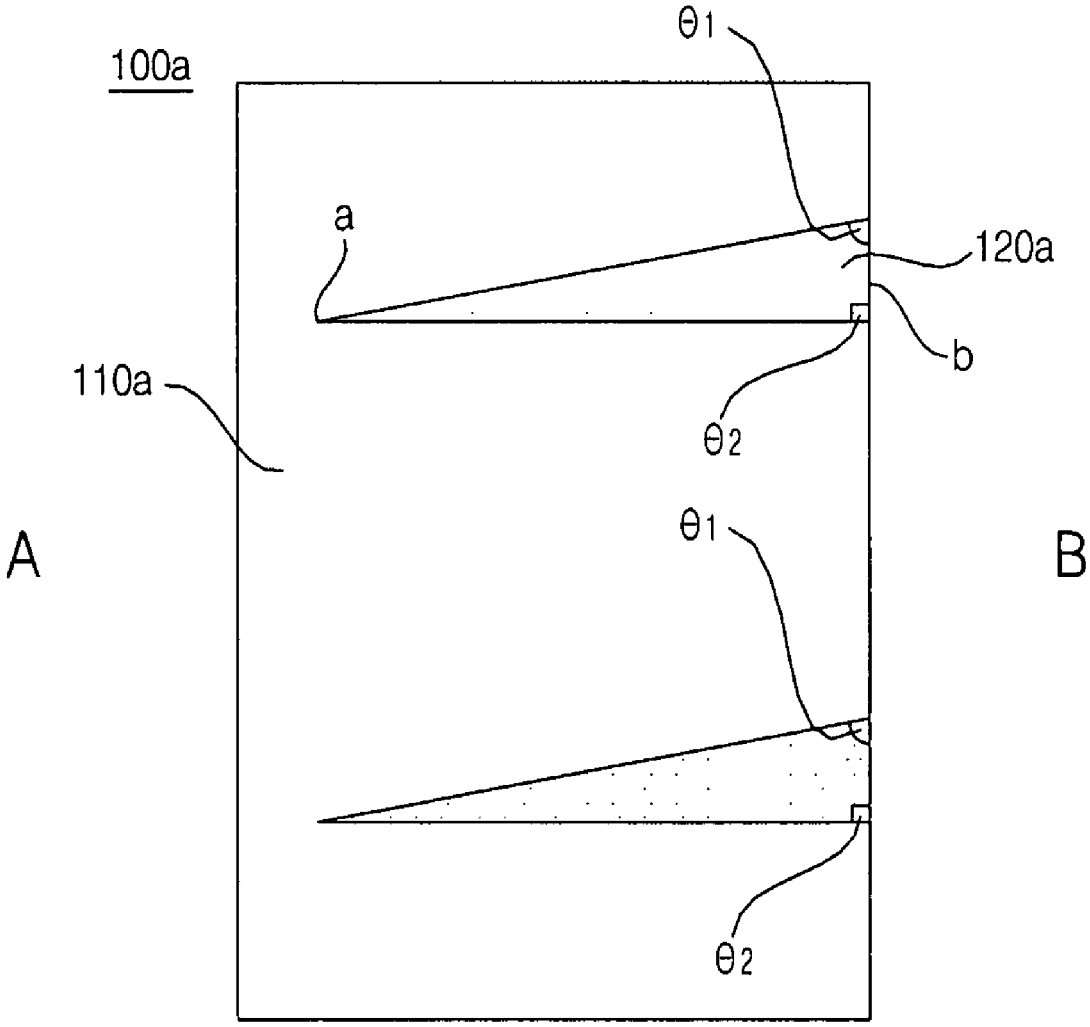
Figure 6:
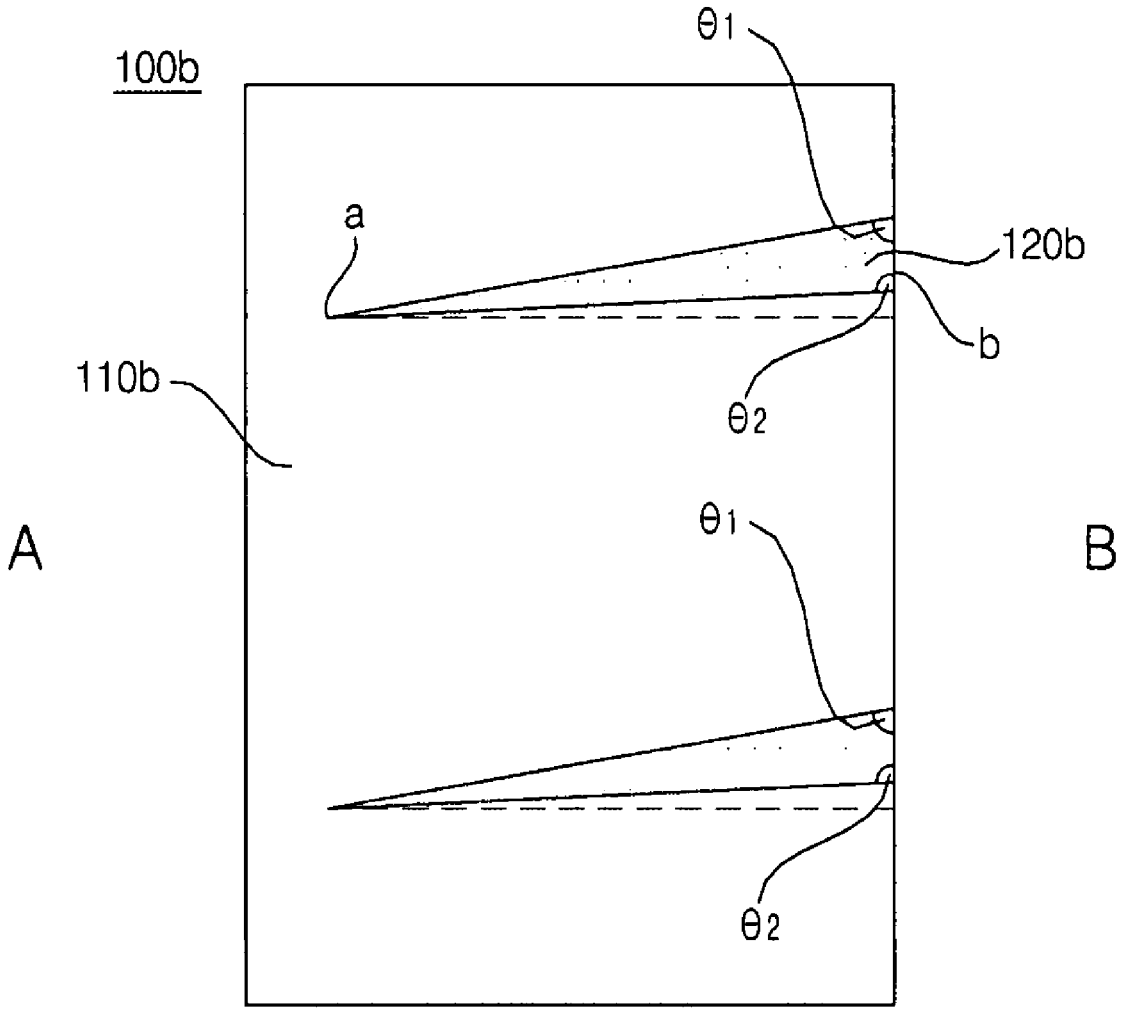

As shown in FIG. 4, the external light shielding sheet 100 may have an acute angle in which the first interior angle θ1 and the second interior angle θ2 greater than the first interior angle θ1 is smaller than 90 degrees. As shown in FIG. 5, an external light shielding sheet 100*a* may have a pattern unit 120*a* in which the second interior angle θ2 greater than the first interior angle θ1 may be a right angle. As shown in FIG. 6, an external light shielding sheet 100*b* of a pattern unit 120*b* in which an obtuse angle in which the second interior angle θ2 greater than the first interior angle θ1 may be 90 degrees to 115 degrees.

As the second interior angle θ2 (greater than the first interior angle θ1) increases, the aperture ratio may improve. However, in order for light emitted from the panel to be totally reflected from the pattern units 120 and then to reach the user, the second interior angle θ2 of the pattern unit 120 may be smaller than 115 degrees as shown in Table 1.

Figure 7:
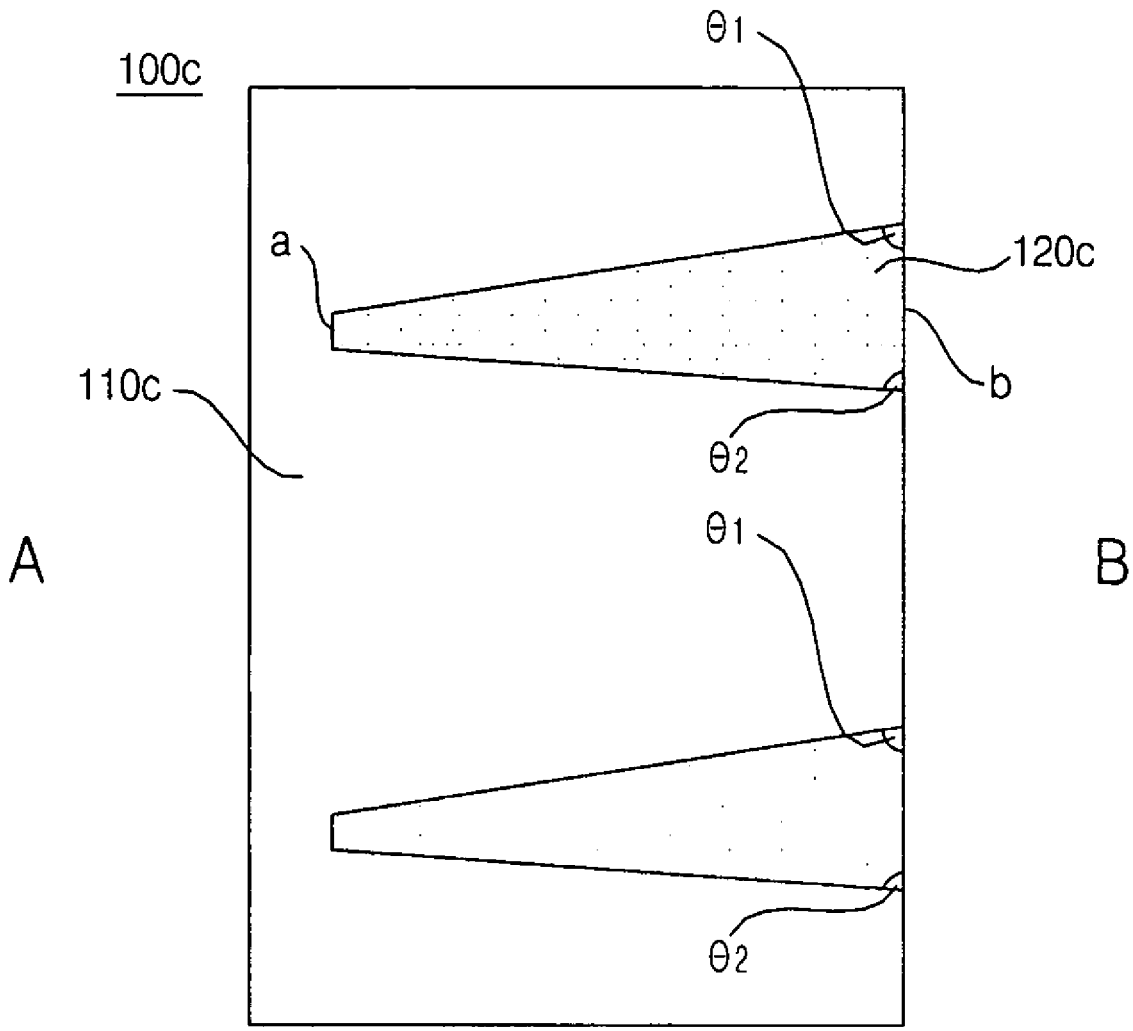
Figure 8:
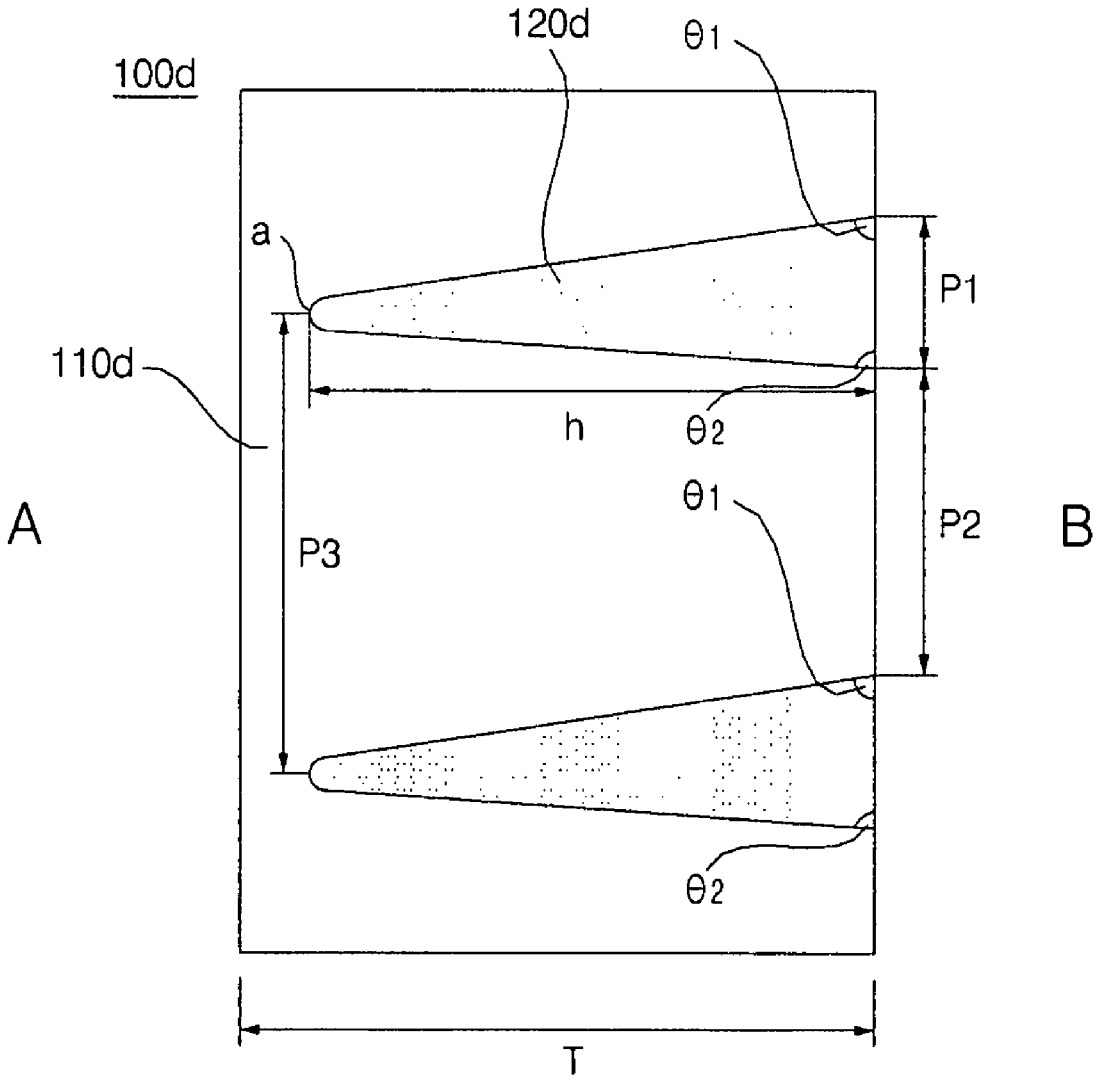

As shown in FIG. 7, a pattern unit 120*c* of an external light shielding sheet 100*c* may have a shape other than a triangle such as polygonal shape (i.e., a square or a trapezoid). Furthermore, as shown in FIG. 8 the top "a" of a pattern unit 120*d* of an external light shielding sheet 100*d* may be curved.

Structure of an external light shielding sheet will be described in more detail with reference to FIGS. 8 and 9. A manufacturing process may be convenient and an adequate optical transmittance can be obtained when a thickness T of the external light shielding sheet is 20 μm to 250 μm. In order for light emitted from the panel to be transmitted smoothly and for externally incident light to be refracted and effectively absorbed and shielded by the pattern units 120 and to secure the robustness of the sheet, the thickness T of the external light shielding sheet may be in a range of 100 μm to 180 μm.

When a height "h" of each of the pattern units included in the external light shielding sheet is 80 μm to 170 μm, fabrication of the pattern units is convenient, an adequate aperture ratio of the external light shielding sheet can be secured, and the external light shielding effect and the effect of reflecting light emitted from the panel can be maximized.

The height "h" of the pattern unit 120 may vary depending on the thickness T of the external light shielding sheet 100. External light that is incident on the panel to affect lowering of bright and dark room contrast of the panel may be located at a location higher than the panel. Thus, in order to effectively shield external light incident on the panel, the height "h" of the pattern unit 120 may have a given value range with respect to the thickness T of the external light shielding sheet.

Figure 9:
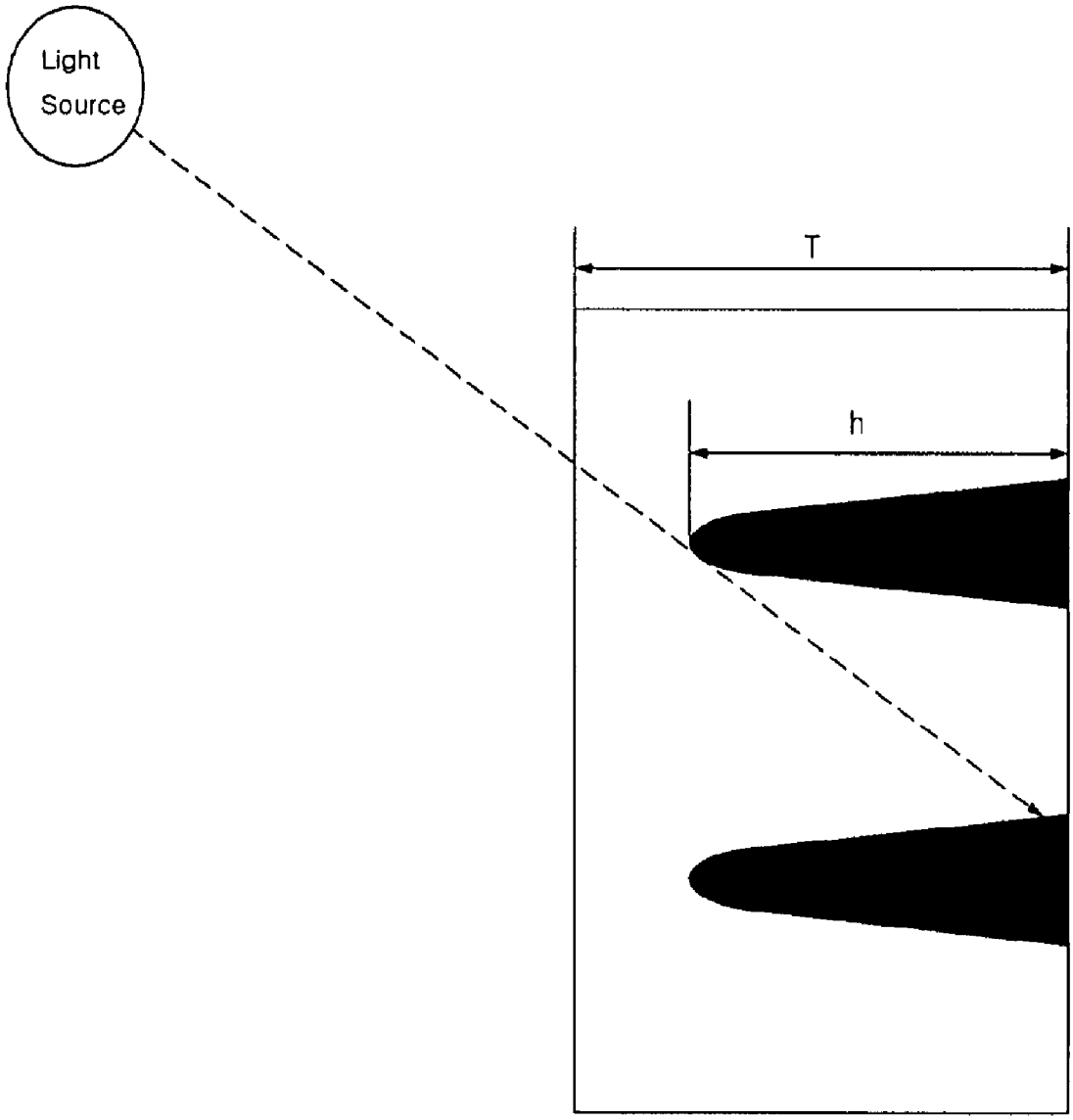

As shown in FIG. 9, as the height "h" of the pattern unit increases, the thickness of the base unit at a top portion of the pattern unit may become thin, which may result in insulating breakdown. As the height "h" of the pattern unit decreases, external light having a given angle range is incident on the panel, which may hinder proper shielding of the external light.

The following Table 2 shows experimental results based on insulating breakdown of an external light shielding sheet and an external light shielding effect depending on thickness T of the external light shielding sheet and height "h" of the pattern unit.

TABLE 2

| Sheet Thickness (T) | Height of Pattern Unit | Insulating Breakdown | External Light Shielding Effect |
|---|---|---|---|
| 120 μm | 120 μm | ○ | ○ |
| 120 μm | 115 μm | □ | ○ |
| 120 μm | 110 μm | X | ○ |
| 120 μm | 105 μm | X | ○ |
| 120 μm | 100 μm | X | ○ |
| 120 μm | 95 μm | X | ○ |
| 120 μm | 90 μm | X | ○ |
| 120 μm | 85 μm | X | ○ |
| 120 μm | 80 μm | X | ○ |
| 120 μm | 75 μm | X | Δ |
| 120 μm | 70 μm | X | Δ |
| 120 μm | 65 μm | X | Δ |
| 120 μm | 60 μm | X | Δ |
| 120 μm | 55 μm | X | Δ |
| 120 μm | 50 μm | X | X |

As shown in Table 2, when the thickness T of the external light shielding sheet is 120 μm, if the height "h" of the pattern unit becomes 120 μm or more, a failure rate of a product may increase since there is a danger that the pattern unit may experience insulating breakdown. If the height "h" of the pattern unit becomes 115 μm or less, the failure rate of the external light shielding sheet may decrease since there is no danger (or less danger) that the pattern unit may experience insulating breakdown. However, when the height of the pattern unit is 75 μm or less, efficiency in which external light is blocked by the pattern unit may decrease. When the height of the pattern unit is 50 μm or less, external light can be incident on the panel.

When the thickness T of the external light shielding sheet is 1.01 to 2.25 times greater than the height "h" of the pattern unit, insulating breakdown at a top portion of the pattern unit may be prevented (or minimized), and external light may be prevented (or minimized) from being incident on the panel. Furthermore, in order to increase the reflectance of light emitted from the panel and to secure a sufficient viewing angle while preventing (or minimizing) insulating breakdown and external light from being incident on the panel, the thickness T of the external light shielding sheet may be 1.01 to 1.5 times greater than the height "h" of the pattern unit.

As shown in FIG. 8, in order to secure the aperture ratio of the external light shielding sheet including the pattern units and maximize the external light shielding effect and the reflection efficiency of the panel interior light, a bottom width P1 of the pattern unit may be in a range of 18 μm to 35 μm by taking fabrication into consideration.

In order for the panel light to be radiated to a user side A in order to secure the aperture ratio for displaying a display image of an adequate luminance and to secure an optimal inclined surface gradient of the pattern units 120 for increasing the external light shielding effect and the panel light reflection efficiency, a shortest distance P2 between neighboring pattern units may be in a range of 40 μm to 90 μm, and a distance P3 between tops of neighboring pattern units may be in a range of 60 μm to 130 nm.

For the above reasons, when the shortest distance P2 between two neighboring pattern units is 1.1 to 5 times greater than a bottom width of the pattern unit 120, an adequate aperture ratio for display can be secured. Furthermore, in order to optimize the external light shielding effect and the panel light reflection efficiency while securing the aperture ratio, the shortest distance P2 between two neighboring pattern units may be 1.5 to 3.5 times greater than the bottom width of the pattern unit 120.

The following Table 3 shows experimental results based on an aperture ratio and an external light shielding effect of the external light shielding sheet depending on bottom width P1 of the pattern unit and a width at a center (h/2) of a height of the pattern unit. In this example, the bottom width of the pattern unit was 23 μm.

TABLE 3

| Bottom Width (μm) of Pattern Unit | Center Width (μm) of Pattern Unit | Aperture Ratio (%) | External Light Shielding Effect |
|---|---|---|---|
| 23.0 | 23.0 | 50 | ○ |
| 23.0 | 22.0 | 55 | ○ |
| 23.0 | 20.0 | 60 | ○ |
| 23.0 | 18.0 | 65 | ○ |
| 23.0 | 16.0 | 70 | ○ |
| 23.0 | 14.0 | 72 | ○ |
| 23.0 | 12.0 | 75 | ○ |
| 23.0 | 10.0 | 78 | ○ |
| 23.0 | 9.0 | 80 | ○ |
| 23.0 | 8.0 | 83 | Δ |
| 23.0 | 6.0 | 85 | Δ |
| 23.0 | 5.0 | 90 | X |

As shown in Table 3, in a case where the bottom width P1 of the pattern unit of the external light shielding sheet 100 is 23.0 μm, if the width at the center (h/2) of the pattern unit is 23 μm, light emitted from the interior of the panel can pass through the user side so that the aperture ratio of 50% or more in which an image is displayed can be secured. However, if the width at the center (h/2) of the pattern unit is 8 μm or less, efficiency in which external light is shielded may decrease. If the width at the center (h/2) of the pattern unit is 5 μm or less, external light can be incident on the panel.

Thus, when the width at the center (h/2) of the pattern unit of the external light shielding sheet is 1 to 3.5 or 1.5 to 2.5 times greater than the bottom width P2, external light can be prevented from being incident on the panel and an adequate aperture ratio can be secured.

The height "h" of the pattern unit may be 0.89 to 4.25 times greater than the shortest distance between neighboring pattern units by taking an angle in which external light is incident on the panel into consideration. In this case, reflection efficiency of light emitted from the interior of the panel and the external light shielding efficiency can be maximized and the upper and lower viewing angles can be secured sufficiently depending on the height "h" of the pattern unit.

In order to secure the highest aperture ratio of the external light shielding sheet, the distance between the tops of neighboring pattern units may be 1 to 3.25 times greater than the shortest distance between neighboring pattern units. Accordingly, the external light shielding efficiency may be maximized while securing the aperture ratio.

Figure 10:
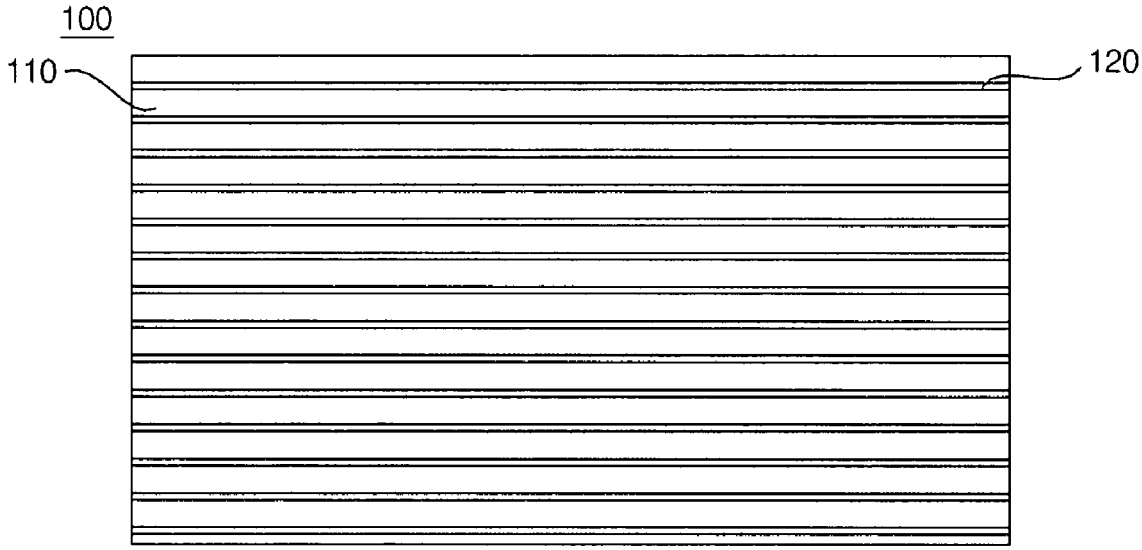
FIG. 10 is a front view of an external light shielding sheet according to an example embodiment of the present invention.

FIG. 10 is a front view of an external light shielding sheet according to an example embodiment of the present invention. Other embodiments and configurations are also within the scope of the present invention.

As shown in FIG. 10, the pattern units 120 may be arranged on the base unit 110 in rows at given intervals. FIG. 10 shows the pattern units 120 are parallel to one another from a top to a bottom of the external light shielding sheet 100. However, the pattern units 120 may also be formed at a tilt angle from the top or bottom of the external light shielding sheet. This may prevent a Moire phenomenon generated by the black matrices, the black layer, the barrier ribs, the bus electrodes, and/or etc. within the panel.

The Moire phenomenon may refer to patterns of low frequency that occur as patterns of a similar lattice shape are overlapped. For example, the Moire phenomenon may refer to wave patterns appearing when mosquito nets are overlapped. The Moire phenomenon may also be associated with not only angles formed by the top or the bottom of the external light shielding sheet and the pattern units, but also with the bottom width of the pattern unit having substantially a same width as the pattern unit, the width of the bus electrode formed within the panel, and the width of the longitudinal barrier rib.

The following Table 4 shows experimental results based on whether a Moire phenomenon and an external light shielding effect has occurred depending on a ratio of the bottom width of the pattern unit of the external light shielding sheet and a width of a bus electrode formed on a front substrate of the panel. In this example, the width of the bus electrode is 90 μm.

TABLE 4

| Bottom Width of Pattern Unit/ Width of Bus Electrode | Moire Phenomenon | External Light Shielding Effect |
|---|---|---|
| 0.10 | Δ | X |
| 0.15 | Δ | X |
| 0.20 | X | Δ |
| 0.25 | X | ○ |
| 0.30 | X | ○ |
| 0.35 | X | ○ |
| 0.40 | X | ○ |
| 0.45 | Δ | ○ |

TABLE 4-continued

| Bottom Width of Pattern Unit/ Width of Bus Electrode | Moire Phenomenon | External Light Shielding Effect |
|---|---|---|
| 0.50 | Δ | ○ |
| 0.55 | ○ | ○ |
| 0.60 | ○ | ○ |

As shown in Table 4, when the bottom width of the pattern unit is 0.2 to 0.5 times the width of the bus electrode, the Moire phenomenon can be reduced and external light incident on the panel can also be reduced. In order to prevent the Moire phenomenon and effectively shield external light while securing the aperture ratio for discharging the panel light, the bottom width of the pattern unit may be 0.25 to 0.4 times greater than the width of the bus electrode.

The following Table 5 shows experimental results based on whether a Moire phenomenon and an external light shielding effect have occurred depending on a ratio of a bottom width of a pattern unit of an external light shielding sheet and a width of a longitudinal barrier rib formed on a rear substrate of the panel. In this example, the width of the longitudinal barrier rib is 50 μm.

TABLE 5

| Bottom Width of Pattern Unit/Top Width of Longitudinal Barrier Rib | Moire Phenomenon | External Light Shielding Effect |
|---|---|---|
| 0.10 | ○ | X |
| 0.15 | Δ | X |
| 0.20 | Δ | X |
| 0.25 | Δ | X |
| 0.30 | X | Δ |
| 0.35 | X | Δ |
| 0.40 | X | ○ |
| 0.45 | X | ○ |
| 0.50 | X | ○ |
| 0.55 | X | ○ |
| 0.60 | X | ○ |
| 0.65 | X | ○ |
| 0.70 | Δ | ○ |
| 0.75 | Δ | ○ |
| 0.80 | Δ | ○ |
| 0.85 | ○ | ○ |
| 0.90 | ○ | ○ |

As shown in Table 5, when the width P1 of the bottom of the pattern unit is 0.3 to 0.8 times greater than the width of the longitudinal barrier rib, the Moire phenomenon can be reduced and external light incident on the panel can also be decreased. In order to prevent the Moire phenomenon and also effectively shield external light while securing the aperture ratio for discharging the panel light, the bottom width of the pattern unit may be 0.4 to 0.65 times greater than the width of the longitudinal barrier rib.

FIGS. 11 to 14 are cross-sectional views illustrating a lamination structure of a filter according to an example embodiment of the present invention. Other embodiments and configurations are also within the scope of the present invention. A filter 200 (or 300) may be formed at a front of the PDP and include an antireflective/near-infrared (AR/NIR) sheet, an electromagnetic interference (EMI) shielding sheet, an external light shielding sheet, an optical characteristic sheet, and/or etc.

As shown in FIGS. 11 to 14, an AR/NIR sheet 210 may include an AR layer 211 disposed at a front of a base sheet 213 made of a transparent plastic material and a NIR shielding layer 212 disposed at a rear of the base sheet 213. The AR layer 211 may prevent (or minimize) externally incident light from reflecting therefrom and thereby decrease a glaring phenomenon. The NIR shielding layer 212 may shield NIR radiated from the panel so that signals transferred using infrared rays (e.g. a remote controller) can be transferred normally.

The base sheet 213 may be formed using a variety of materials by taking use conditions or transparency, an insulating property, a heat-resistance property, mechanical strength, etc. into consideration. For example, the base sheet 213 may be made of materials such as poly polyester-based resin, polyamid-based resin, polyolefin-based resin, vinyl-based resin, acryl-based resin, cellulose-based resin, and/or etc. The base sheet 213 may be formed using a polyester-based material such as polyethylene tereophthalate (PET) and polyethylene naphthalate (PEN) having good transparency and transmittance of a visible ray of 80% or greater. The thickness of the base sheet 213 may be in a range of 50 μm to 500 μm considering that it may prevent or minimize damage to the sheet by overcoming weak mechanical strength and save cost by having a necessary thickness.

The AR layer 211 may include an anti-reflection layer. The NIR shielding layer 212 may be formed using an NIR absorbent that can be utilized and in which NIR transmittance of a wavelength band of 800 μm to 1100 μm emitted from the PDP is 20% or less, and preferably 10% or less. The NIR absorbent may be formed using materials such as NIR absorbent pigments having a high optical transmittance of a visible ray region (e.g. polymethine-base, cyanine-based compound, phthalocyanine-based compound, naphthalocyanine-based compound, buthalocyanine-based compound, anthraquinone-based compound, dithiol-based compound, imonium-based compound, and/or immonium-based compound).

The EMI shielding sheet 220 may include an EMI shielding layer 221 disposed at a front of a base sheet 222 made of a transparent plastic material. The EMI shielding layer 221 may shield EMI to thereby prevent EMI radiated from the panel from being emitting externally. The EMI shielding layer 221 may be formed to have a mesh structure using a conductive material.

In order to ground the EMI shielding layer 221, a conductive material may be entirely coated on an outside of the pattern (i.e., an invalid region of the EMI shielding sheet 220 on which an image is not displayed). Materials of the metal layer forming the pattern of the EMI shielding sheet 220 may include metal with an enough conductivity to shield electronic waves such as gold, silver, iron, nickel, chrome and/or aluminum. The materials may be used as a single material, an alloy or multiple layers.

If a black oxidization process is performed on the bottom of the pattern, bright and dark room contrast of a panel, such as the black matrix formed within the panel, can be improved. The black oxidization process may be performed on at least one side of an outer circumference of the pattern so that it has a color darker than the base unit. In this case, when external light such as sunlight or electrical light is incident on the panel, the blackened portion may prohibit and/or absorb reflection to thereby improve a display image of the PDP with a high contrast.

The black oxidization process may include a plating method. In this case, the black oxidization process may be easily performed on all the surfaces of the pattern since adherence force of the plating method is excellent. The plating materials may include one or more compounds selected from copper, cobalt, nickel, zinc, tin and/or chrome, for example, as well as oxide compounds such as copper oxide, copper dioxide and oxidized steel.

The pattern width of the EMI shielding layer 221 may be 10 μm to 30 μm. In this case, a sufficient electrical resistance value for EMI shielding can be obtained and the aperture ratio for an adequate optical transmittance can be secured.

An external light source may exist in a room, outside the room or over a head of a user. An external light shielding sheet 230 may be used to represent a black image of the PDP as dark by effectively shielding the external light.

Adhesive 240 may be formed between the AR/NIR sheet 210, the EMI shielding sheet 220 and the external light shielding sheet 230 so that each of the sheets 210, 220, 230 forming the filter 200 can be firmly adhered at the front of the panel. The base sheets 213, 222 may be included between the respective sheets and may be formed using substantially a same material by taking convenience of fabrication of the filter 200 into consideration.

Figure 11:
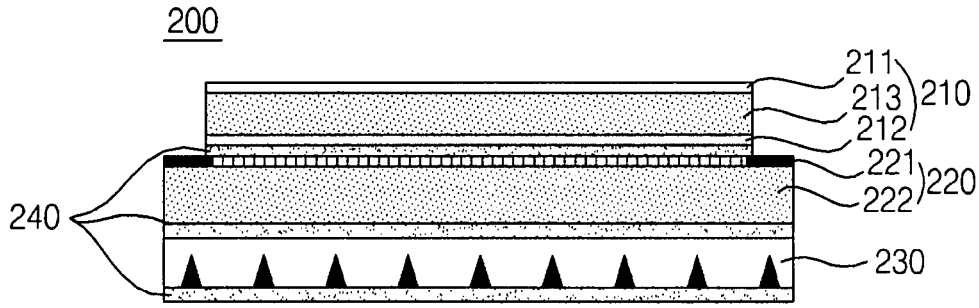
FIGS. 11 to 14 are cross-sectional views illustrating a lamination structure of a filter according to an example embodiment of the present invention.
Figure 12:
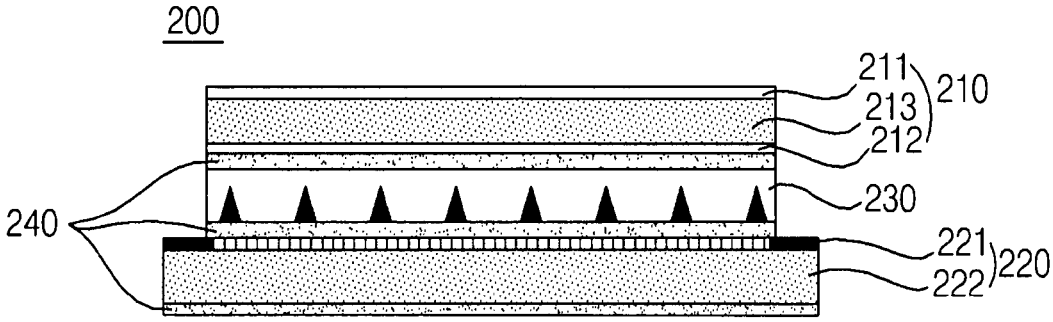

In FIG. 11, the AR/NIR sheet 210, the EMI shielding sheet 220 and the external light shielding sheet 230 are sequentially laminated. However, as shown in FIG. 12, the AR/NIR sheet 210, the external light shielding layer 230, and the EMI shielding sheet 220 may be sequentially laminated. Furthermore, the lamination sequence of the respective sheets may be changed. One of the sheets 210, 220 or 230 may also not be provided.

Figure 13:
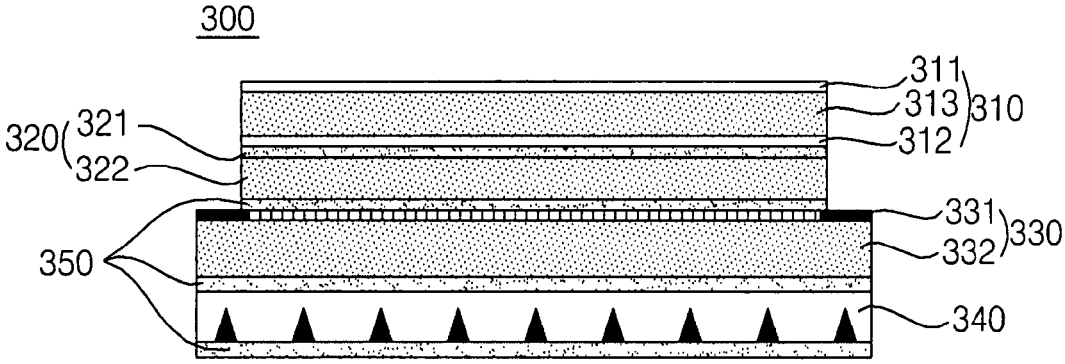
Figure 14:
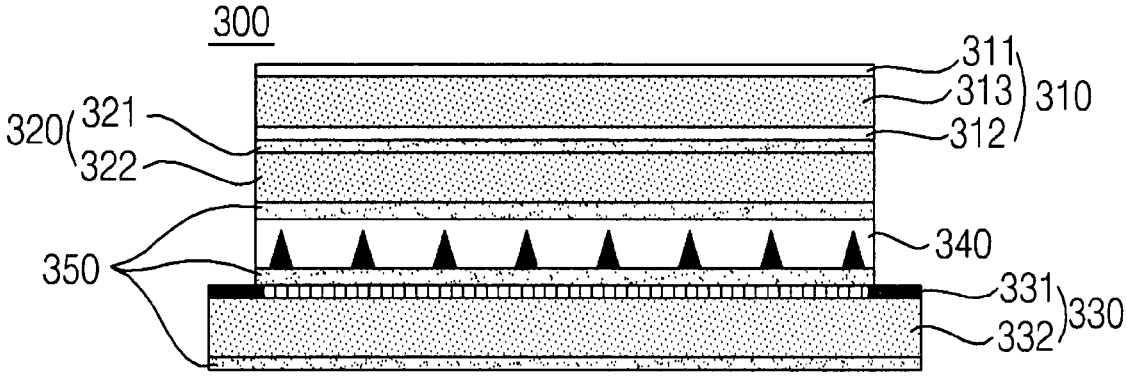

As shown in FIGS. 13 and 14, a filter 300 disposed at a front of a panel may include an AR/NIR sheet 310, an optical characteristic sheet 320, an EMI shielding sheet 330 and an external light shielding sheet 340. The optical characteristic sheet 320 may improve a color temperature and a luminance characteristic of light incident from the panel. The optical characteristic sheet 320 may include a base sheet 322 made of a transparent plastic material and an optical characteristic layer 321 made of dyes and an adhesive laminated at a front or rear of the base sheet 322.

The AR/NIR sheet 310 may include an AR layer 311 disposed at a front of a base sheet 313 (made of transparent plastic material) and a NIR shielding layer 312 disposed at a rear of the base sheet 313. The EMI shielding sheet 330 may include an EMI shielding layer 331 disposed at a front of a base sheet 332 (made of transparent plastic material).

An external light source may exist in a room, outside the room or over a head of a user. An external light shielding sheet 340 may be used to represent a black image of the PDP as dark by effectively shielding the external light.

Adhesive 350 may be formed between the AR/NIR sheet 310, the optical characteristic sheet 320, the EMI shielding sheet 320 and/or the external light shielding sheet 330 so that each of the sheets 310, 320, 330 forming the filter 300 can be firmly adhered at the front of the panel. The base sheets 313, 322, 332 may be included between the respective sheets and may be formed using substantially a same material by taking convenience of fabrication of the filter into consideration.

One of the base sheets included in each of the sheets shown in FIGS. 11 to 14 may also be omitted. Additionally, one of the base sheets may be formed using glass rather than plastic material in order to improve protecting of the panel. The glass may be spaced apart from the panel at a given distance.

Figure 15:
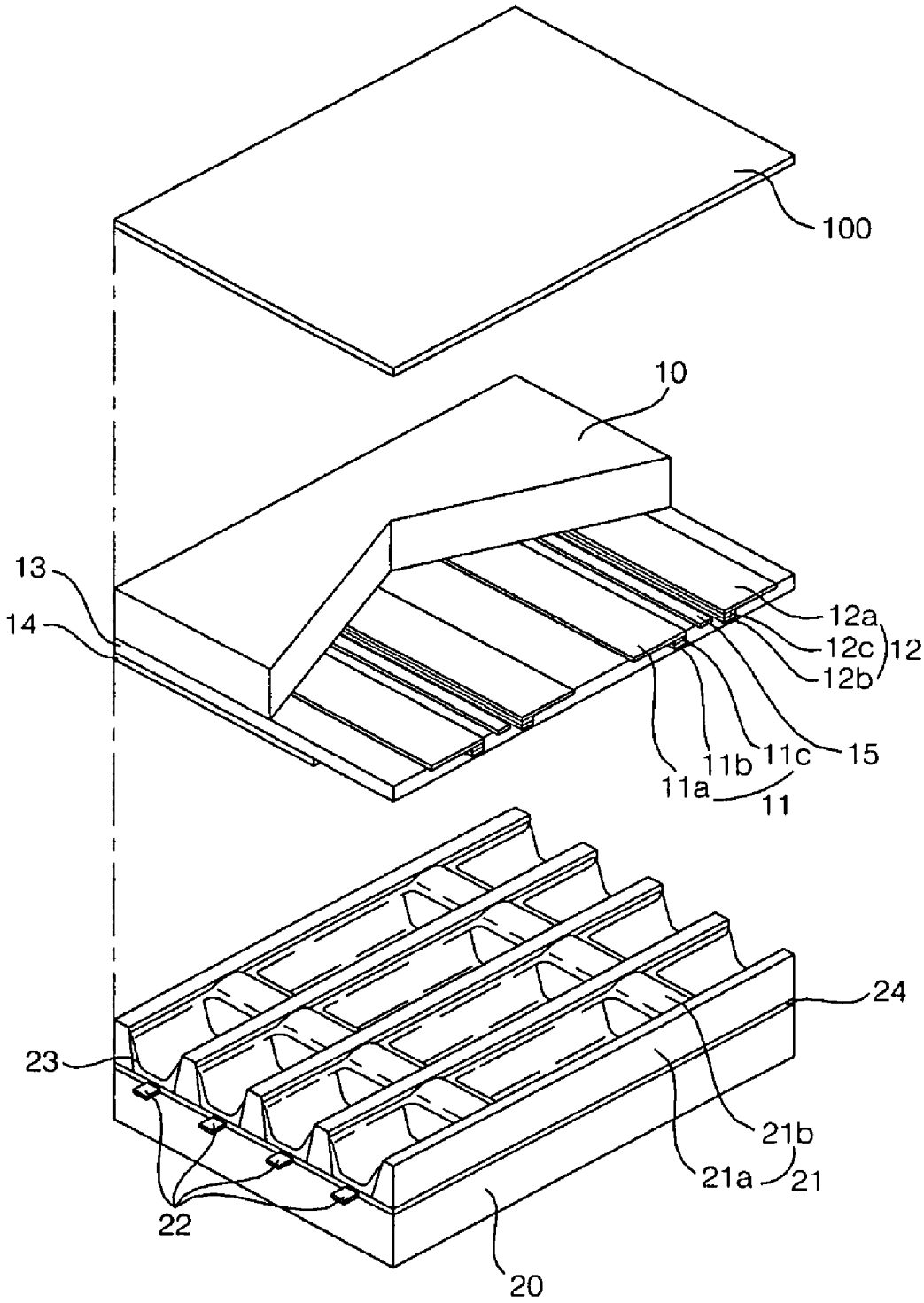
FIG. 15 is a perspective view of a plasma display apparatus according to an example embodiment of the present invention.

FIG. 15 is a perspective view of a plasma display apparatus according to an example embodiment of the present invention. Other embodiments and configurations are also within the scope of the present invention.

As shown in FIG. 15, a filter 400 may be formed at a front of the PDP. The filter 400 may include an external light shielding sheet, an AR sheet, a NIR shielding sheet, an EMI shielding sheet, an optical characteristic sheet, and/or etc.

An adhesive layer having a thickness of 10 to 30 μm may be layered between the filter 400 and the panel to facilitate the attachment of the panel and the filter 400 and to increase the adhesive property. In order to protect the panel from external pressure, etc., an adhesive layer having a thickness of 30 to 120 μm may be formed between the filter 400 and the panel.

Embodiments of the present invention may provide a plasma display apparatus including an external light shielding sheet to prevent reflection of light by effectively shielding external light incident on a panel, significantly enhancing bright and dark room contrast of a PDP, and/or improving luminance of the panel.

A plasma display apparatus according to an example embodiment of the present invention may include a PDP and a filter disposed at a front of the PDP. The filter may include an external light shielding sheet including a base unit and a plurality of pattern units formed on the base unit. A thickness of the external light shielding sheet may be in a range of 1.01 to 2.25 times greater than a height of each of the pattern units. A first interior angle formed by an upper-side inclined surface of the pattern unit and a bottom of the pattern unit may differ from a second interior angle formed by a lower-side inclined surface of the pattern unit and the bottom of the pattern unit.

The second interior angle of the pattern unit may be 1.01 to 1.45 and/or 1.02 to 1.32 times greater than the first interior angle. The second interior angle of the pattern unit may be 81 to 115 degrees.

Furthermore, a distance between neighboring pattern units may be 1.1 to 5 times greater than a bottom width of the pattern unit. A height of the pattern unit may be 0.89 to 4.25 times greater than a shortest distance between neighboring pattern units. A distance between tops of neighboring pattern units may be 1 to 3.25 times greater than the shortest distance between the pattern units.

Furthermore, a refractive index of the pattern unit may be 0.300 to 0.999 times greater than a refractive index of the base unit.

The filter may include at least one of an anti-reflection layer configured to prevent reflection of external light, an NIR shielding layer configured to shield NIR radiated from the PDP, and an EMI shielding layer configured to shield EMI.

The plasma display apparatus according to an example embodiment of the present invention may include an external light shielding sheet capable of absorbing and blocking externally incident light and securing an aperture ratio of a panel. This may effectively implement a black image and improve luminance of the screen.

In accordance with the plasma display apparatus according to an example embodiment of the present invention, external light incident on an interior of a panel may be shielded and bright and dark room contrast can be improved. Furthermore, in order to improve bright and dark room contrast of a PDP, a black matrix, an anti-reflection layer attached to a filter, and so may be used. However, external light incident on the interior of discharge cells of a panel can be effectively blocked. Accordingly, bright and dark room contrast of a panel can be significantly improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display apparatus comprising:

a plasma display panel (PDP); and a filter disposed at a front of the PDP, the filter including an external light shielding sheet having a base unit and a plurality of pattern units formed on the base unit, wherein each of the pattern units includes a bottom and first and second slanted surfaces which are connected to the bottom, a thickness of the external light shielding sheet is in a range of 1.01 to 1.5 times greater than a height of each of the pattern units and a first interior angle between the first slanted surface and the bottom of each of the pattern units differs from a second interior angle between the second slanted surface and the bottom of each of the pattern units.

2. The plasma display apparatus of claim 1, wherein the first interior angle is smaller than the second interior angle.

3. The plasma display apparatus of claim 1, wherein the second interior angle is 1.01 to 1.45 times greater than the first interior angle.

4. The plasma display apparatus of claim 1, wherein the second interior angle is 1.02 to 1.32 times greater than the first interior angle.

5. The plasma display apparatus of claim 1, wherein the second interior angle is 81 degrees to 115 degrees.

6. The plasma display apparatus of claim 1, wherein a width of the bottom of each of the pattern units is 1 to 3.5 times greater than a width at a center of a height of each of the pattern units.

7. The plasma display apparatus of claim 1, wherein a distance between the bottoms of neighboring pattern units is 1.1 to 5 times greater than a width of the bottom of each of the pattern units.

8. The plasma display apparatus of claim 1, wherein a height of each of the pattern units is 0.89 to 4.25 times greater than a distance between the bottoms of neighboring pattern units.

9. The plasma display apparatus of claim 1, wherein a distance between tops of neighboring pattern units is 1 to 3.25 times greater than a distance between the bottoms of the neighboring pattern units.

10. The plasma display apparatus of claim 1, wherein a refractive index of each of the pattern units is smaller than a refractive index of the base unit.

11. The plasma display apparatus of claim 1, wherein a refractive index of each of the pattern units is 0.300 to 0.999 times greater than a refractive index of the base unit.

12. The plasma display apparatus of claim 1, wherein the filter includes at least one of an anti-reflection layer to prevent reflection of external light, a near-infrared (NIR) shielding layer to shield NIR radiated from the PDP, and an electromagnetic interference (EMI) shielding layer to shield EMI.

13. The plasma display apparatus of claim 1, wherein a width of the bottom of each of the pattern units is in a range of 18 μm to 35 μm.

14. The plasma display apparatus of claim 1, wherein a height of each of the pattern units is in a range of 80 μm to 170 μm.

15. The plasma display apparatus of claim 1, wherein a distance between the bottoms of neighboring pattern units is in a range of 40 μm to 90 μm.

16. A filter comprising:

an external light shielding sheet which includes a base unit and a plurality of pattern units formed on the base unit, wherein each of the pattern units includes a bottom and first and second slanted surfaces which are connected to the bottom, a thickness of the external light shielding sheet is in a range of 1.01 to 1.5 times greater than a height of each of the pattern units and a first interior angle between the first slanted surface and the bottom of each of the pattern units differs from a second interior angle between the second slanted surface and the bottom of each of the pattern units.

17. The filter of claim 16, wherein the first interior angle is smaller than the second interior angle.

18. The filter of claim 16, wherein the second interior angle is 1.01 to 1.45 times greater than the first interior angle.

19. The filter of claim 16, wherein the second interior angle is 1.01 to 1.32 times greater than the first interior angle.

20. The filter of claim 16, wherein the second interior angle is 81 degrees to 115 degrees.

21. The filter of claim 16, wherein the width of the bottom of each of the pattern units is 1 to 3.5 times greater than a width at a center of a height of each of the pattern units.

22. The filter of claim 16, wherein a distance between the bottoms of neighboring pattern units is 1.1 to 5 times greater than a width of the bottom of each of the pattern units.

23. The filter of claim 16, wherein a height of each of the pattern units is 0.89 to 4.25 times greater than a distance between the bottoms of neighboring pattern units.

24. The filter of claim 16, wherein a distance between tops of neighboring pattern units is 1 to 3.25 times greater than a distance between the bottoms of the neighboring pattern units.

25. The filter of claim 16, further comprising at least one of an anti-reflection layer to prevent reflection of external light, an NIR shielding layer to shield NIR radiated from a PDP, or an EMI shielding layer to shield EMI.

26. The filter of claim 16, wherein a refractive index of each of the pattern units is 0.300 to 0.999 times greater than a refractive index of the base unit.

27. The filter of claim 16, wherein the thickness of the external light shielding sheet is 100 μm to 180 μm.

28. The filter of claim 16, wherein the height of each of the pattern units is 80 μm to 110 μm.

* * * * *